US009881756B1

(12) United States Patent
Dutov et al.

(10) Patent No.: US 9,881,756 B1
(45) Date of Patent: Jan. 30, 2018

(54) CONTROL SYSTEM FOR A CONTACTOR

(71) Applicant: LG Chem, Ltd., Seoul (KR)

(72) Inventors: Pavel Dutov, Troy, MI (US); Alexander J. Smith, White Lake, MI (US); Richard A. McCormick, Troy, MI (US); Adam Ing, Madison Heights, MI (US)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 15/335,900

(22) Filed: Oct. 27, 2016

(51) Int. Cl.
*H01H 47/00* (2006.01)

(52) U.S. Cl.
CPC ..... *H01H 47/00* (2013.01)

(58) Field of Classification Search
CPC ..... H01H 47/00; H01H 47/04; H01M 10/425; H01M 10/44; H01M 10/48; H02J 7/0031; Y10T 307/696; Y10T 307/944; H01F 7/1805
USPC ..... 307/9.1, 10.1, 140
See application file for complete search history.

(56) References Cited

U.S. PATENT DOCUMENTS

| | | | | |
|---|---|---|---|---|
| 6,043,996 | A | 3/2000 | Kumar | |
| 8,993,142 | B2 | 3/2015 | Sakai et al. | |
| 9,146,281 | B2 | 9/2015 | Bolduc | |
| 2003/0218843 | A1* | 11/2003 | Tsukasaki | H02H 3/207 361/90 |
| 2013/0009464 | A1* | 1/2013 | Firehammer | H01M 10/425 307/9.1 |
| 2015/0155115 | A1* | 6/2015 | Johansson | H01H 9/563 307/140 |

* cited by examiner

*Primary Examiner* — Daniel Kessie
(74) *Attorney, Agent, or Firm* — Buckert Patent & Trademark Law Firm PC; John F. Buckert

(57) ABSTRACT

An exemplary contactor control system and method to reduce the amount of sound during the translation of an automotive contactor from a closed state to an open state is provided. The contactor has an electrical coil and first and second electrical contacts. The control system includes a microcontroller and a high side driver circuit. The microcontroller generates a pulse width modulated signal that is applied to the high side driver circuit and decreases a duty cycle thereof to decrease a first control voltage applied to the electrical coil over a time interval. The microcontroller maintains a duty cycle for another time interval to maintain the contactor in the closed operational state. Next, the microcontroller decreases the duty cycle to reduce a speed of a contactor armature prior to contacting a stop member to reduce an amount of sound while transitioning the contactor to the open state.

7 Claims, 9 Drawing Sheets

CONTROL SYSTEM FOR A CONTACTOR

BACKGROUND

When a contactor in a vehicle transitions from a closed operational state to an open operational state, the contactor can generate an undesirable amount of noise in the interior region of the vehicle. Accordingly, the inventors herein recognized the need for an improved control system for controlling a contactor that reduces a velocity of a contactor armature prior to impacting a stop member that minimizes the contactor noise when transitioning from the closed operational state to the open operational state.

SUMMARY

A control system for a contactor in accordance with an exemplary embodiment is provided. The contactor has an electrical coil and first and second electrical contacts. The control system includes a current sensor generating a first signal indicating an amount of an electrical current flowing through the first and second electrical contacts. The first signal is received by a microcontroller. The control system further includes a high side driver circuit electrically coupled to and between the microcontroller and a first end of the electrical coil of the contactor. The microcontroller is programmed to generate a first voltage signal over a first time interval that is applied to the high side driver circuit to induce the high side driver circuit to apply a first control voltage at a first voltage level to the first end of the electrical coil of the contactor to transition the contactor from an open operational state in which the first and second electrical contacts are disposed apart from one another to a closed operational state in which the first and second electrical contacts are contacting one another. The microcontroller is further programmed to generate a pulse width modulated signal that is applied to the high side driver circuit and to decrease a duty cycle of the pulse width modulated signal from a first duty cycle to a second duty cycle to induce the high side driver circuit to decrease the first control voltage applied to the electrical coil from the first voltage level to a second voltage level, respectively, over a second time interval. The microcontroller is further programmed to maintain the second duty cycle of the pulse width modulated signal for a third time interval to induce the high side driver circuit to maintain the first control voltage applied to the electrical coil at the second voltage level for the second time interval to maintain the contactor in the closed operational state. The third time interval is greater than the second time interval. The microcontroller is programmed to receive an open command message requesting that the contactor be transitioned from the closed operational state to the open operational state. The microcontroller is further programmed to determine a current level value indicating the amount of the electrical current flowing through the first and second electrical contacts, based on the first signal. The microcontroller is further programmed to decrease the duty cycle of the pulse width modulated signal applied to the high side driver circuit from the second duty cycle to a zero duty cycle to induce the high side driver circuit to decrease the first control voltage applied to the electrical coil from the second voltage level to a ground voltage level, respectively, over a fourth time interval to transition the contactor from the closed operational state to the open operational state, if the current level value is less than or equal to a threshold current value, and the open command message corresponds to a first predetermined open command message.

DETAILED DESCRIPTION

Figure 1:
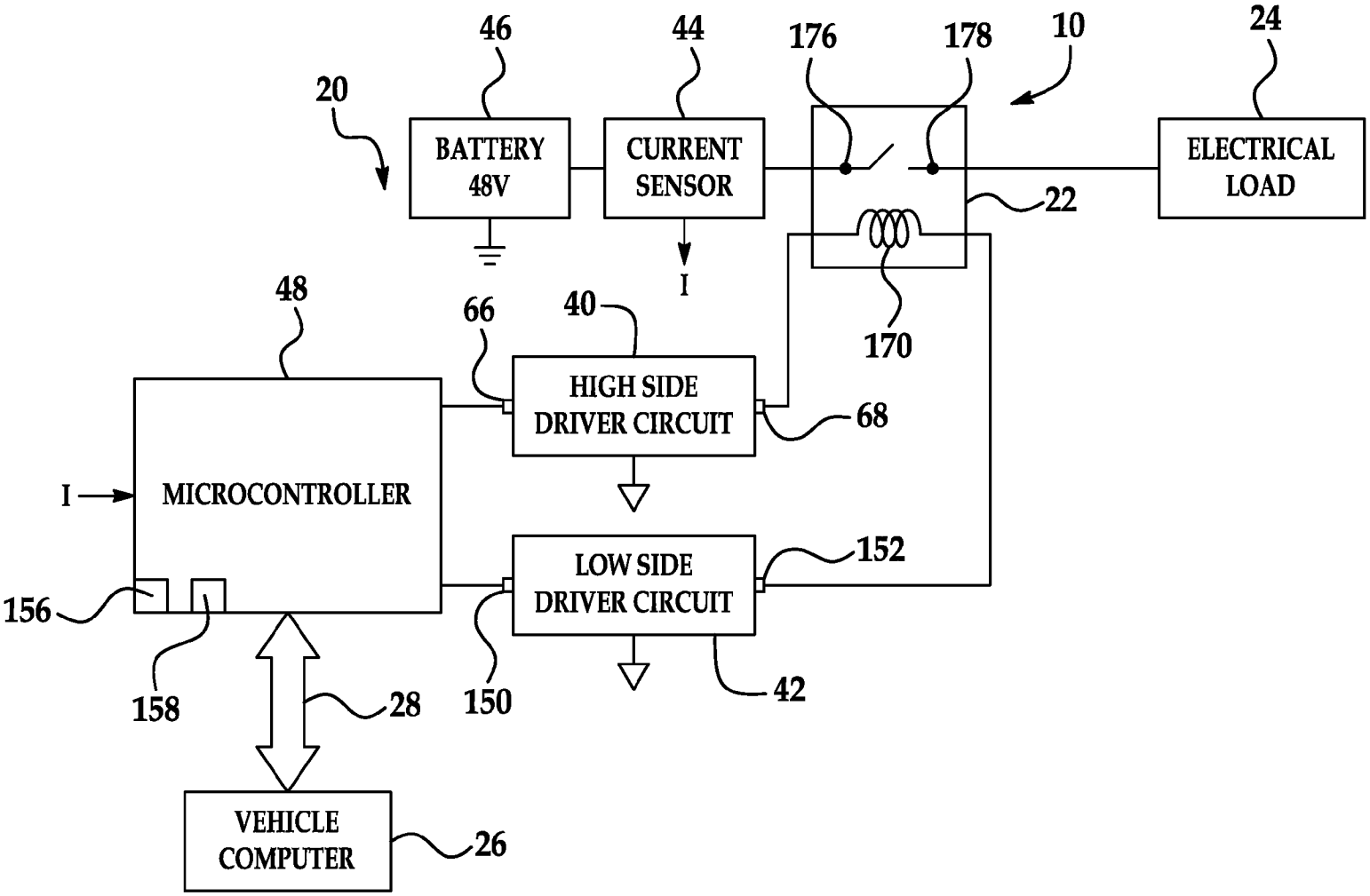
FIG. 1 is a schematic of a vehicle having a control system for a contactor in accordance with an exemplary embodiment.

Referring to FIG. 1, a vehicle 10 has a control system 20 for controlling a contactor 22 in accordance with an exemplary embodiment. The vehicle 10 further includes an electrical load 24, a vehicle computer 26, and a communication bus 28. An advantage of the control system 20 is that the control system 20 transitions the contactor 22 to a closed operational state, and then decreases a control voltage from a first voltage level to a second voltage level that is applied to a contactor coil 170. Thereafter, the control system 20 maintains the control voltage at the second voltage level to maintain the contactor 22 in the closed operational state. When the contactor 22 is to be transitioned to an open operational state, the control system 20 decreases the control voltage to a ground-level voltage such that a contactor armature of the contactor 22 moves at a decreased speed prior to contacting a stop member 182 (shown in FIG. 3) at the open operational state. As a result, an amount of noise generated by the contactor 22 when transitioning to the open operational state is significantly reduced.

Figure 2:
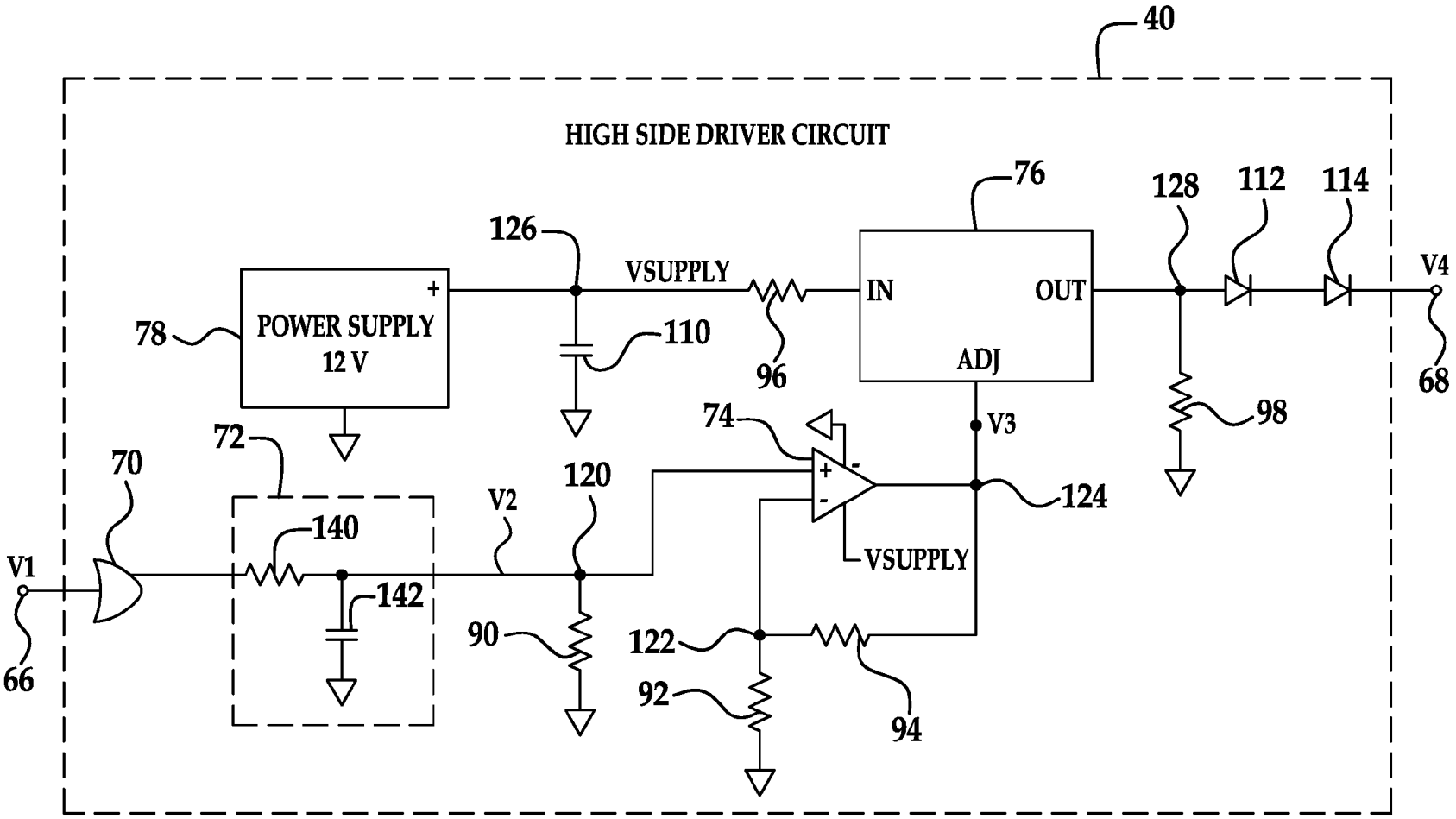
FIG. 2 is a schematic of a high side driver circuit utilized in the control system of FIG. 1.

Referring to FIGS. 1 and 2, the control system 20 includes a high side driver circuit 40, a low side driver circuit 42, a current sensor 44, a battery 46, and a microcontroller 48.

The high side driver circuit 40 is provided to generate a control voltage that is received by the electrical coil 170 of the contactor 22 to transition the contactor 22 from an open operational state to a closed operational state. The high side driver circuit 40 is further provided to stop generating the control voltage to transition the contactor 22 from the closed operational state to the open operational state. The high side driver circuit 40 is electrically coupled to and between the microcontroller 48 and a first end of the electrical coil 170 of the contactor 22. The high side driver circuit 40 includes an input node 66, an output node 68, a logical OR gate 70, a low pass filter 72, an operational amplifier 74, a voltage regulator 76, a power supply 78, resistors 90, 92, 94, 96, 98, a capacitor 110, diodes 112, 114, and electrical nodes 120, 122, 124, 126.

Figure 5:
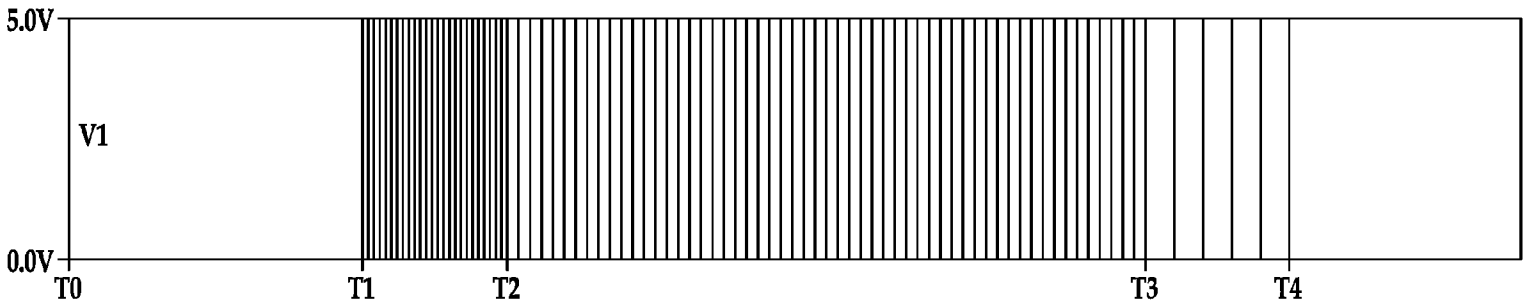
FIG. 5 is a schematic of a voltage signal that is output by a microcontroller in the control system of FIG. 1 to the high side driver circuit of FIG. 2.
Figure 6:
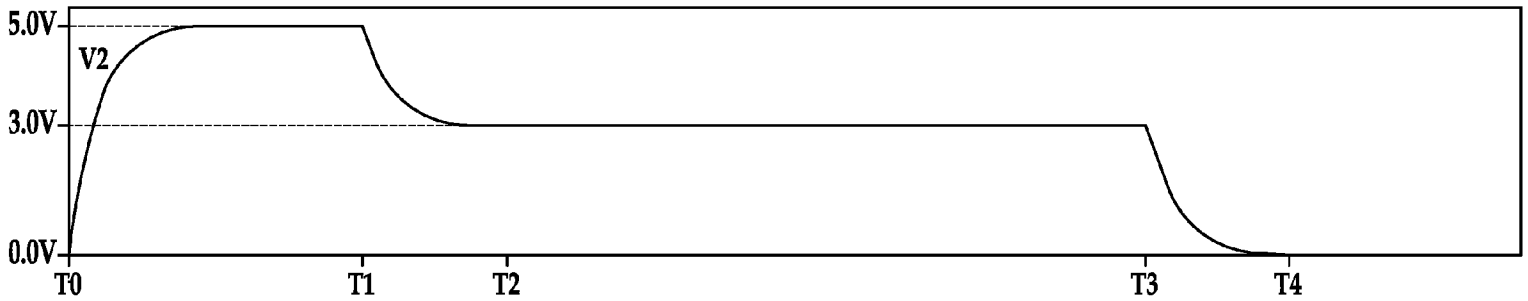
FIG. 6 is a schematic of a voltage signal output by a low pass filter in the high side driver circuit of FIG. 2.
Figure 7:
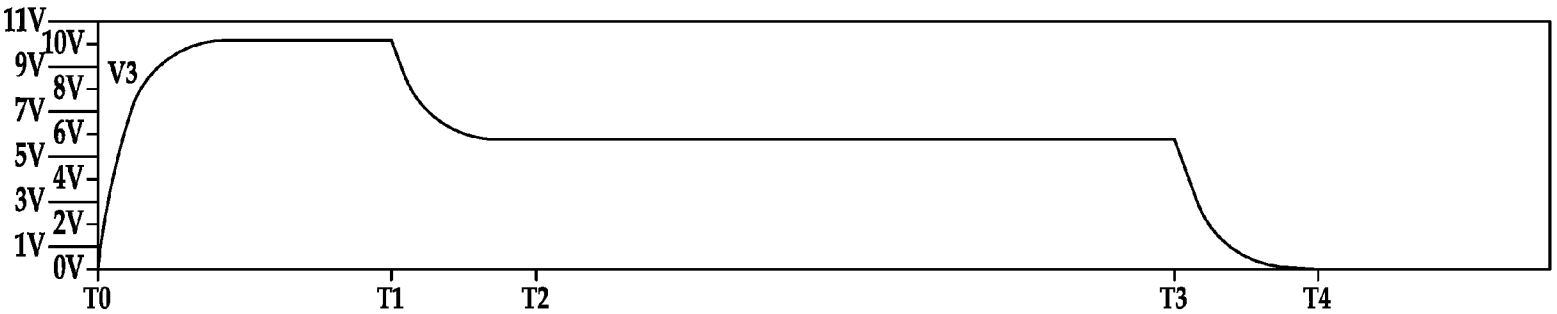
FIG. 7 is a schematic of a voltage signal output by an amplifier in the high side driver circuit of FIG. 2.
Figure 8:
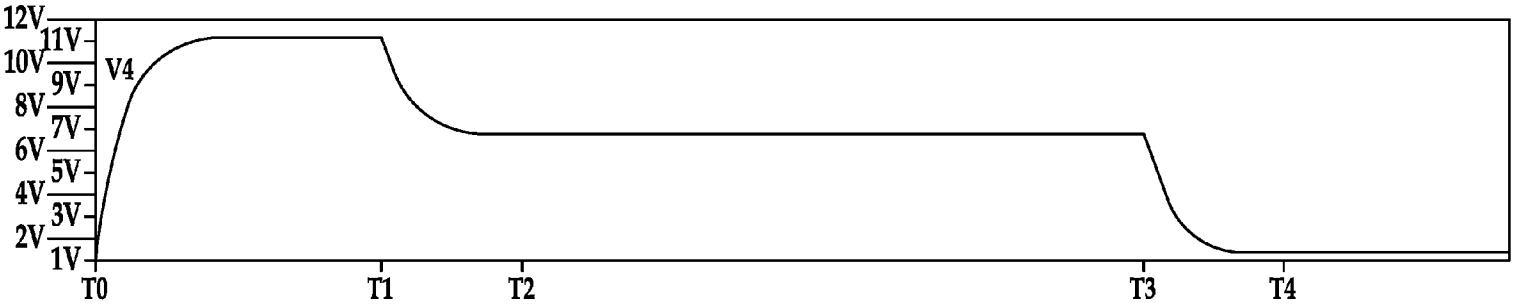
FIG. 8 is a schematic of a control voltage output by a voltage regulator in the high side driver circuit of FIG. 2.
Figure 9:
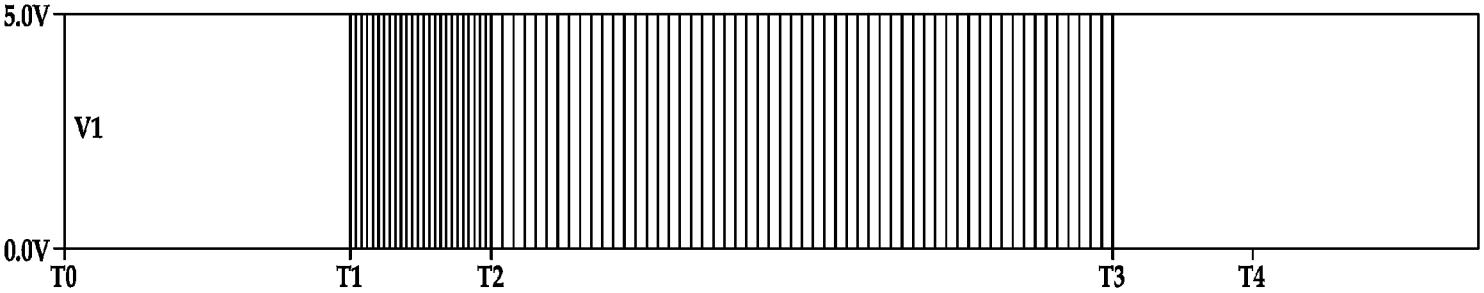
FIG. 9 is a schematic of another voltage signal that is output by the microcontroller to the high side driver circuit of FIG. 2.
Figure 10:
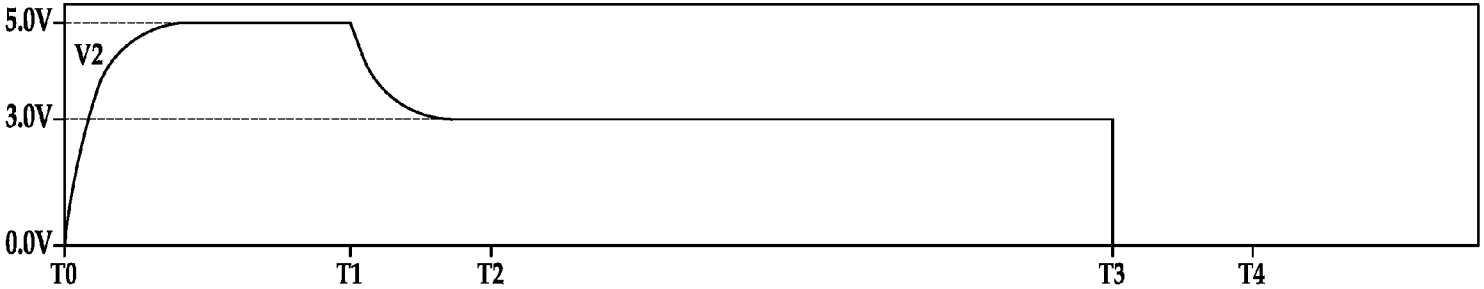
FIG. 10 is a schematic of another voltage signal output by the low pass filter in the high side driver circuit of FIG. 2.
Figure 11:
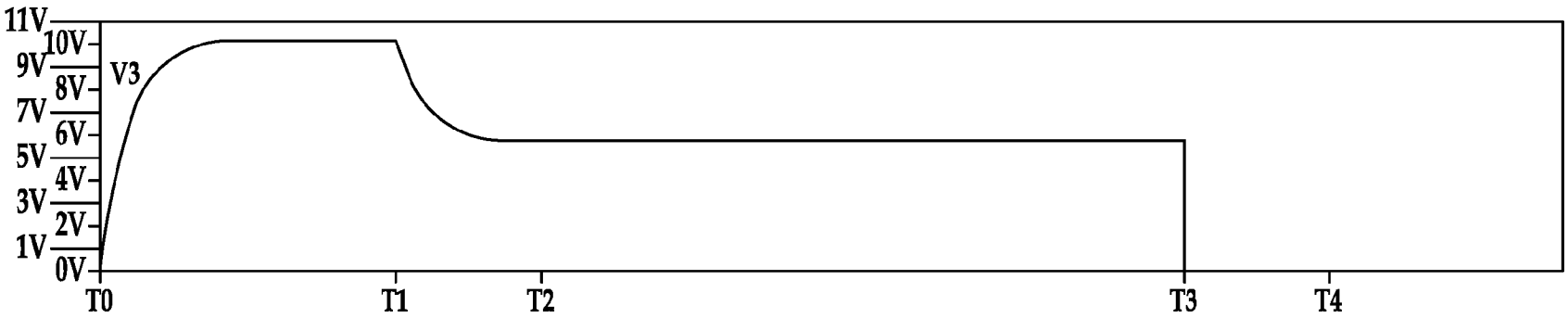
FIG. 11 is a schematic of another voltage signal output by the amplifier in the high side driver circuit of FIG. 2.
Figure 12:
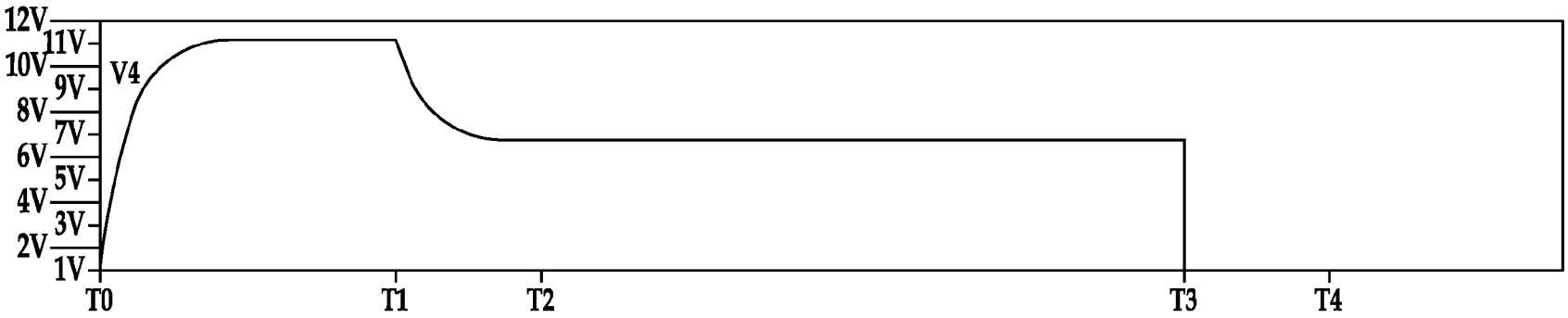
FIG. 12 is a schematic of another control voltage output by the voltage regulator in the high side driver circuit of FIG. 2.
Figure 13:
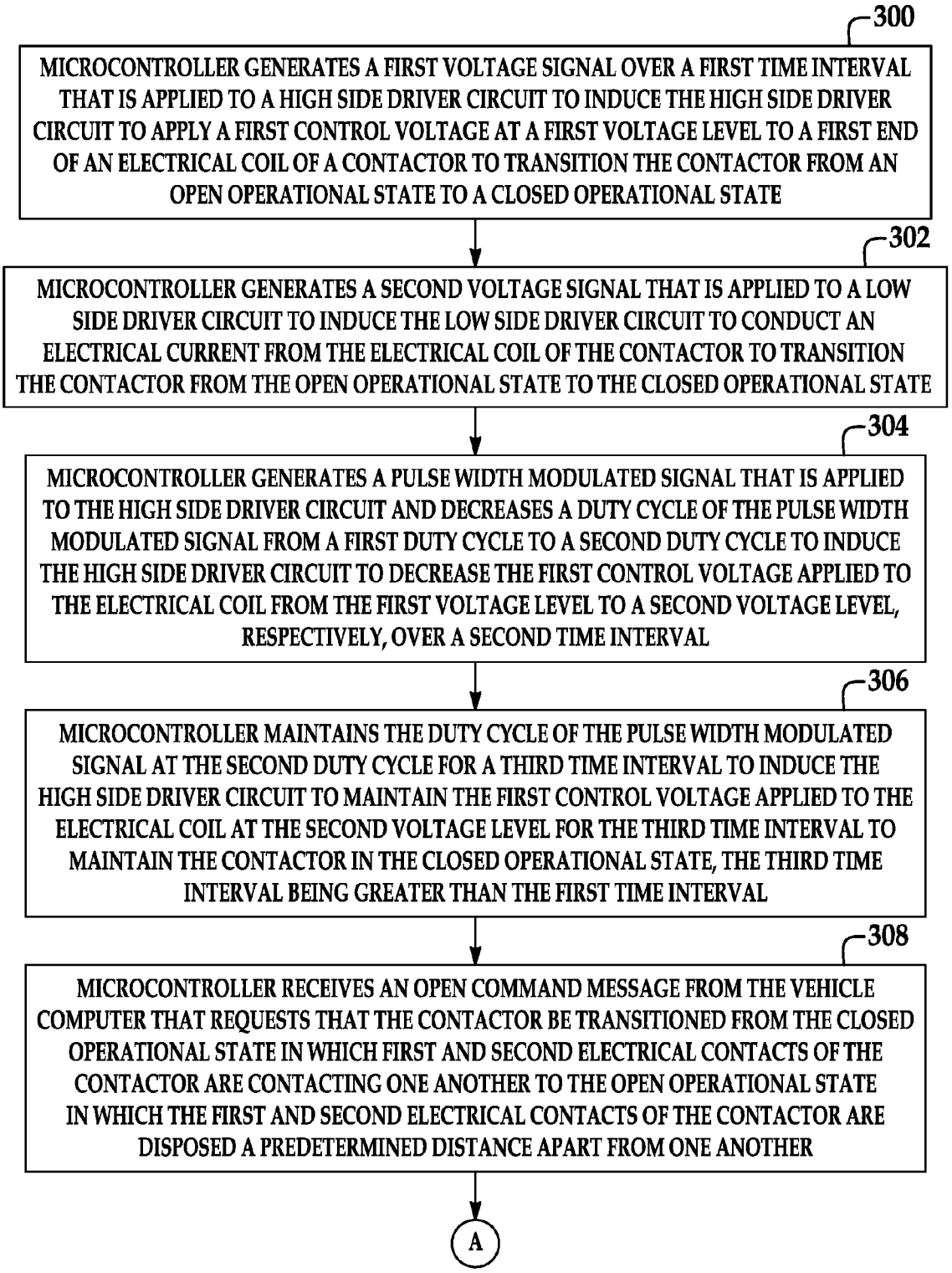
FIGS. 13-15 is a flowchart of a method for controlling a contactor in accordance with another exemplary embodiment.
Figure 14:
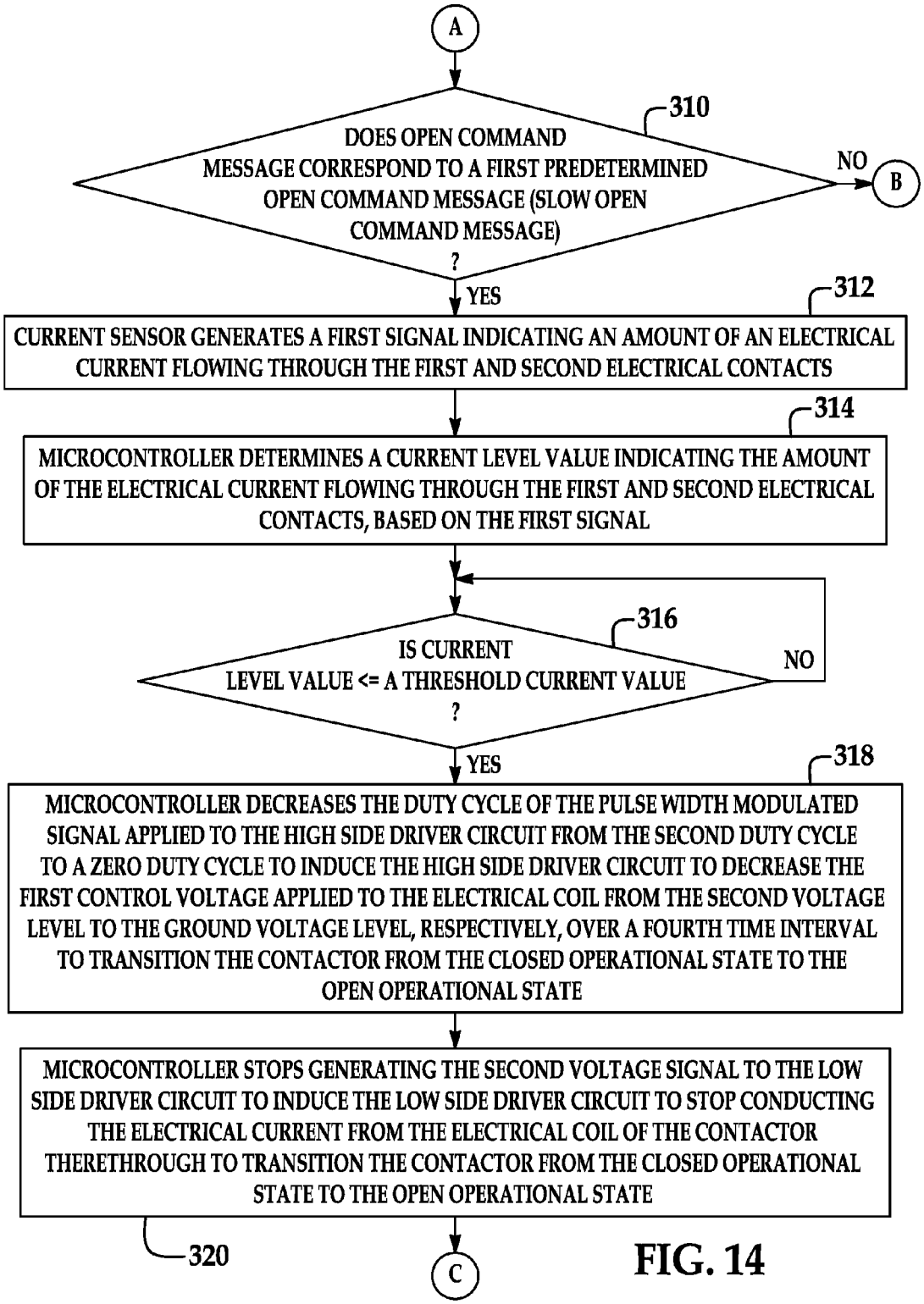
Figure 15:
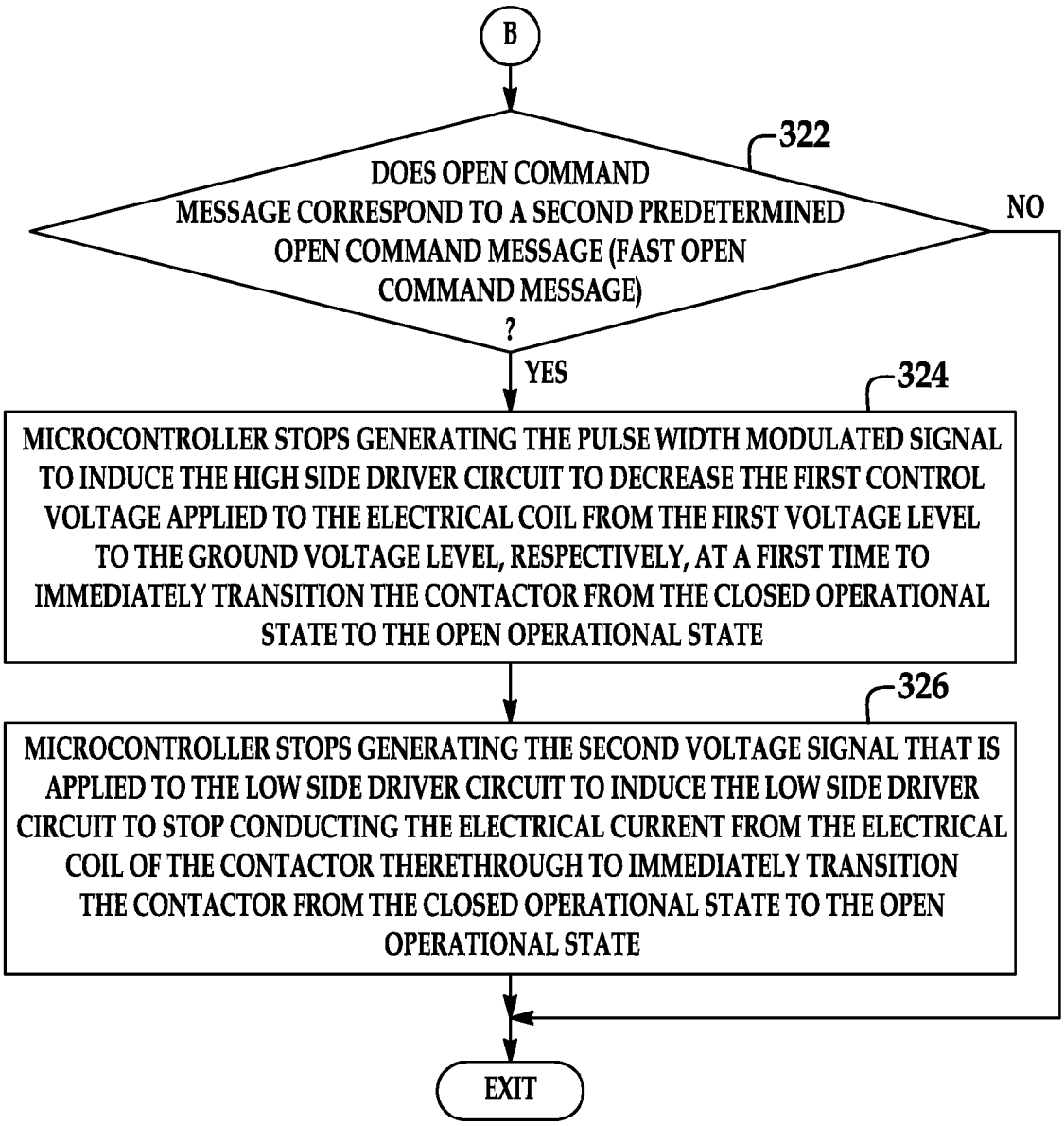

The logical OR gate 70 includes an input node and an output node. The input node of the logical OR gate 70 is electrically coupled to the input node 66 of the high side driver circuit 40. The output node of the logical OR gate 70 is electrically coupled to a resistor 140 of the low pass filter 72. During operation, the logical OR gate 70 receives a voltage (V1) (which is a pulse width modulated signal having a 100% duty cycle between times T0-T1, and having a duty cycle less than 100% between times T1-T4 shown in FIG. 5) from the microcontroller 48 and outputs a voltage that is received by the low pass filter 72.

The low pass filter 72 includes the resistor 140 and a capacitor 142. The resistor 140 is electrically coupled to and between the output terminal of the logical OR gate 70 and an electrical node 120. The capacitor 142 is electrically coupled to and between the electrical node 120 and electrical ground. Further, the resistor 90 is electrically coupled between the electrical node 120 and electrical ground.

The operational amplifier 74 is provided to receive a control voltage from the low pass filter 72 and to output another control voltage having a magnitude greater than a magnitude of the received control voltage, in response to the received control voltage. The operational amplifier 74 includes a non-inverting input terminal (+), an inverting input terminal (−), and an output terminal. The non-inverting input terminal (+) is electrically coupled to the low pass filter 72 and the electrical node 120. The inverting input terminal (−) is electrically coupled to the electrical node 122. The output node of the operational amplifier 74 is further electrically coupled to electrical node 124, which is further electrically coupled to an adjustment terminal (ADJ) of the voltage regulator 76. The operational amplifier 74 is further electrically coupled to the power supply 78 and to electrical ground such that the voltage (VSUPPLY) from the power supply 78 energizes the operational amplifier 74.

The resistor 92 is electrically coupled to and between the electrical node 122 and electrical ground. Further, the resistor 94 is electrically coupled to and between the electrical nodes 122, 124.

The voltage regulator 76 includes the adjustment terminal (ADJ), an input terminal (IN), and an output terminal (OUT). The input terminal (IN) is electrically coupled to the power supply 78 utilizing the resister 96. The resister 96 is electrically coupled to and between the input terminal (IN) and a positive terminal of the power supply 78. The electrical node 126 is electrically coupled to both the resister 96 and the positive terminal of the power supply 78. Further, the capacitor 110 is electrically coupled to and between the electrical node 126 and electrical ground. The output terminal (OUT) is electrically coupled to the electrical node 128. During operation, the voltage regulator 76 receives a control voltage from the operational amplifier 74 and outputs another control voltage in response to the control voltage from the operational amplifier 74. The control voltage from the voltage regular 76 is applied to a first end of the electrical coil 170 of the contactor 22.

The resistor 98 is electrically coupled between the electrical node 128 and the ground. The diodes 112, 114 are electrically coupled in series with one another between the electrical node 128 and the output node 68 of the high side driver circuit 40.

Referring to FIGS. 1, 2 and 5-8, the operation of the high side driver circuit 40 will now be explained. It is assumed that the low side driver circuit 42 conducts an electrical current from the electrical coil in the contactor 22 between times T0 and T4. Further, it is assumed that the microcontroller 48 receives a command message from the vehicle computer 26 corresponding to a first predetermined open command (e.g., a slow open command message) at a time T3.

Between times T0 and T1, the microcontroller 48 generates a voltage signal (V1) at 5 volts, the low pass filter 72 outputs a voltage (V2) which increases from 0 volts to 5.0 volts between times T0 and T1, respectively. Further, the operational amplifier 74 outputs a control voltage (V3) which increases from 0 volts to 10 volts between times T0 and T1, respectively. Still further, the voltage regulator 76 outputs a control voltage (V4) which increases from 0 volts to 11 volts between times T0 and T1, respectively. The control voltage (V4) is received by the electrical coil 170 of the contactor 22, and the electrical coil 170 is energized when the low side driver circuit 42 conducts electrical current through the electrical coil 170, to transition the contactor 22 from an open operational state to a closed operational state.

Between times T1 and T2, the microcontroller 48 generates a pulse width modulated signal (V1) and decreases a duty cycle of the pulse width modulated signal (V1) from a first duty cycle to a second duty cycle, the low pass filter 72 outputs a voltage (V2) which decreases from 5.0 volts to 3.0 volts between times T1 and T2, respectively. Further, the operational amplifier 74 outputs a control voltage (V3) which decreases from 10 volts to 6 volts between times T1 and T2, respectively. Still further, the voltage regulator 76 outputs a control voltage (V4) which decreases from 11 volts to 7 volts between times T1 and T2, respectively. The control voltage (V4) maintains the contactor 22 in the closed operational state between times T1 and T2.

Between times T2 and T3, the microcontroller 48 maintains the pulse width modulated signal (V1) at the second duty cycle, the low pass filter 72 outputs a voltage (V2) which is maintained at 3.0 volts between times T2 and T3, respectively. Further, the operational amplifier 74 outputs a control voltage (V3) which is maintained at 6 volts between times T2 and T3, respectively. Still further, the voltage regulator 76 outputs a control voltage (V4) which is maintained at 7 volts between times T2 and T3, respectively. The control voltage (V4) maintains the contactor 22 in the closed operational state between times T2 and T3.

At time T3, the microcontroller 48 receives a command message from the vehicle controller 26 corresponding to a first predetermined open command (e.g., a soft open command message) for reducing an amount of noise while opening the contactor 22, the microcontroller 48 decreases the duty cycle of the pulse width modulated signal (V1) from the second duty cycle to a zero duty cycle, and the low pass filter 72 decreases the voltage (V2) from 3.0 volts to zero volts. Further, the operational amplifier 74 decreases the control voltage (V3) from 6 volts to zero volts between times T3 and T4. Still further, the voltage regulator 76 decreases the control voltage (V4) from 7 volts to zero volts which induces the contactor 22 to transition to an open operational state between times T3 and T4.

Referring to FIGS. 1, 2 and 9-12, the operation of the high side driver circuit 40 will now be explained in further detail.

From times T0-T3, the voltages (V1), (V2), (V3), (V4) are identical to the voltages (V1), (V2), (V3), (V4) in FIGS. 5-8, respectively. It is assumed that the low side driver circuit 42 conducts an electrical current from the electrical coil in the contactor 22 between times T0 and T3. Further, it is assumed that the microcontroller 48 receives a command message from the vehicle computer 26 corresponding to a second predetermined open command message (e.g., a fast open command message) at a time T3.

At time T3, the microcontroller 48 receives the command message from the vehicle controller 26 corresponding to the second predetermined open command message (e.g., a fast open command message), the microcontroller 48 stops generating the pulse width modulated signal (V1), and the low pass filter 72 immediately decreases the voltage (V2) from 3.0 volts to zero volts. Further, the operational amplifier 74 immediately decreases the control voltage (V3) from 6 volts to zero volts. Still further, the voltage regulator 76 immediately decreases the control voltage (V4) from 7 volts to zero volts which induces the contactor 22 to transition to an open operational state at time T3.

Referring to FIGS. 1 and 2, the low side driver circuit 42 is provided to conduct electrical current from the electrical coil 170 therethrough, in response to receiving a voltage signal from the microcontroller 48. The low side driver circuit 42 includes an input node 150, an output node 152. The low side driver circuit 42 is electrically coupled to and between the microcontroller 48 and a second end of the electrical coil 170 of the contactor 22. In particular, the input node 150 is electrically coupled to the microcontroller 48, and the output node 152 is electrically coupled to the second end of the electrical coil 170 of the contactor 22.

Figure 3:
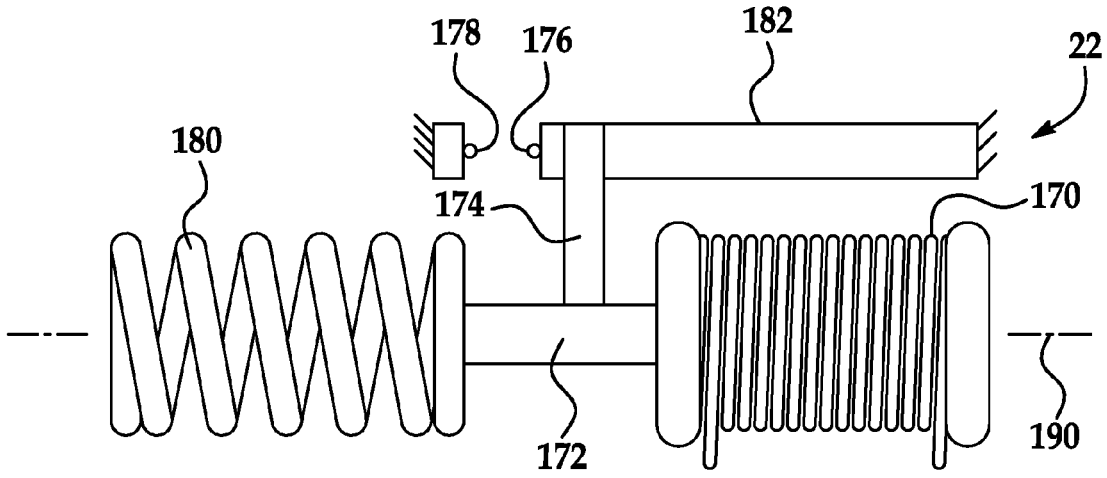
FIG. 3 is a schematic of the contactor of FIG. 1 in an open operational state.

Referring to FIGS. 1 and 3, the current sensor 44 is provided to generate a first signal indicating an amount of an electrical current flowing through electrical contacts 176, 178 of the contactor 22. The first signal is received by the microcontroller 48. In an exemplary embodiment, an amplitude of the first signal is proportional to amplitude of the electrical current flowing through the contacts 176, 178 of the contactor 22. The current sensor 44 is electrically coupled in series between the positive terminal of the battery 46 and the electrical contact 176 of the contactor 22.

The battery 46 is provided to output a voltage that is received by the electrical load 24 for energizing the electrical load 24. In an exemplary embodiment, the battery 46 outputs 48 volts. Of course, in an alternative embodiment, the battery 46 could output a voltage greater than 48 volts or less than 48 volts.

The microcontroller 48 includes a microprocessor 156 and a memory device 158. The microcontroller 48 is programmed to perform at least a portion of the steps described herein, and executes software instructions stored in the memory device 158 to perform the associated steps. The microcontroller 48 operably communicates with the memory device 158, the vehicle computer 26, and the current sensor 44. The microcontroller 48 is further electrically coupled to the high side driver circuit 40 and the low side driver circuit 42.

Figure 4:
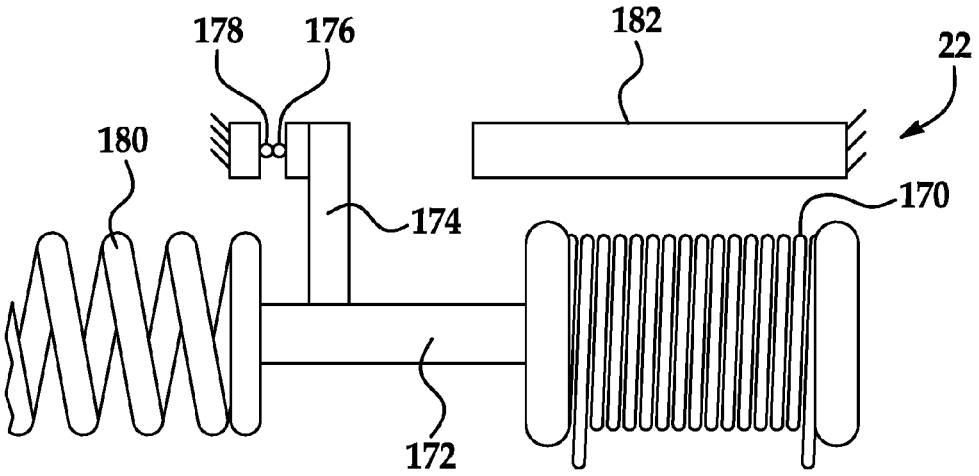
FIG. 4 is another schematic of the contactor of FIG. 1 in a closed operational state.

Referring to FIGS. 3 and 4, the contactor 22 is provided to supply an operational voltage from the battery 46 to the electrical load 24 when the contactor 22 has a closed operational state, and to stop supplying the operational voltage to the electrical load 24 when the contactor 22 has an open operational state. The contactor 22 includes an electrical coil 170, shaft 172, a contactor armature 174, electrical contacts 176, 178, a spring 180, and a stopper 182.

The shaft 172 extends along a longitudinal axis and is coupled to the spring 180. The shaft 172 is adapted to move along the longitudinal axis 190. A portion of the shaft 172 extends through an interior region defined by the electrical coil 170. The contactor armature 174 is coupled to the shaft 172 between the electrical coil 170 and the spring 180. The contactor armature 174 is adapted to hold the electrical contact 176 thereon.

The stopper 182 is disposed above the electrical coil 170 is provided to stop movement of the contactor armature 174 when the contactor armature 174 contacts the stopper 182.

During operation, when the contactor 22 has an open operational state (shown in FIG. 3), the spring 180 urges the shaft 172 rightwardly such that the electrical contacts 176, 178 are disposed a predetermined distance apart from one another, and the contactor armature 174 is disposed on and against the stopper 182. Alternately, when the contactor 22 has a closed operational state (shown in FIG. 4), the energized electrical coil 170 urges the shaft 172 leftwardly such that the electrical contacts 176, 178 contact one another, and the contactor armature 174 is disposed a distance away from the stopper 182, and the spring 180 is compressed.

When the shaft 172 contacts the stopper 182 an undesirable amount of noise can be generated if the shaft 172 is moving quickly immediately prior to contacting the stopper 182. The method described below utilizes a slow open command message and associated pulse width modulated voltages to reduce a speed of the contactor armature 174 prior to contacting the stopper 102 to reduce the amount of sound generated by transitioning the contactor 22 to an open operational state.

Referring to FIG. 1, the vehicle computer 26 operably communicates with the microcontroller 48 utilizing the communication bus 28. The vehicle computer 26 is adapted to generate an open command message that is transmitted through the communication bus 28 to the microcontroller 48. The open command message can correspond to either a first predetermined open command message (e.g., a slow open command message) or a second predetermined open command message (e.g., a fast open command message). The first predetermined open command message results in a reduced amount of noise being generated by the contactor 22 when transitioning the contactor 22 from the closed operational state to the open operational state.

Referring to FIGS. 1, 2 and 13-15, a flowchart of a method for controlling the contactor 22 in accordance with another exemplary embodiment is provided.

At step 300, the microcontroller 48 generates a first voltage signal (V1) over a first time interval (e.g., T0-T1) that is applied to the high side driver circuit 40 to induce the high side driver circuit 40 to apply a first control voltage (V4) at a first voltage level to a first end of the electrical coil 170 of the contactor 22 to transition the contactor 22 from the open operational state to the closed operational state.

At step 302, the microcontroller 48 generates a second voltage signal that is applied to the low side driver circuit 42 to induce the low side driver circuit 42 to conduct an electrical current from the electrical coil 170 of the contactor 22 to transition the contactor 22 from the open operational state to the closed operational state. The step 302 is performed simultaneously with the step 300.

At step 304, the microcontroller 48 generates a pulse width modulated signal (V1) that is applied to the high side driver circuit 40 and decreases a duty cycle of the pulse width modulated signal (V1) from a first duty cycle to a second duty cycle to induce the high side driver circuit 40 to decrease the first control voltage applied to the electrical coil 170 from the first voltage level to a second voltage level, respectively, over a second time interval (e.g., T1-T2). After step 304, the method advances to step 306.

At step 306, the microcontroller 48 maintains the duty cycle of the pulse width modulated signal (V1) at the second duty cycle for a third time interval (e.g., T2-T3) to induce the high side driver circuit 40 to maintain the first control voltage (V4) applied to the electrical coil 170 at the second voltage level for the third time interval to maintain the contactor 22 in the closed operational state. The third time interval (e.g., T2-T3) is greater than the first time interval (e.g., T0-T1). After step 306, the method advances to step 308.

At step 308, the microcontroller 48 receives an open command message from the vehicle computer 26 that requests that the contactor 22 be transitioned from the closed operational state in which electrical contacts 176, 178 (shown in FIG. 4) of the contactor 22 are contacting one another to the open operational state in which the electrical contacts 176, 178 of the contactor 22 are disposed a predetermined distance apart from one another. After step 308, the method advances to step 310.

At step 310, the microcontroller 48 makes a determination as to whether the open command message corresponds to a first predetermined open command message (slow open command message). If the value of step 310 equals "yes", the method advances to step 312. Otherwise, the method advances to step 322.

At step 312, the current sensor 44 generates a first signal indicating an amount of an electrical current flowing through the electrical contacts 176, 178 (shown in FIG. 4). After step 312, the method advances to step 314.

At step 314, the microcontroller 48 determines a current level value indicating the amount of the electrical current flowing through the electrical contacts 176, 178, based on the first signal. After step 314, the method advances to step 316.

At step 316, the microcontroller 48 makes a determination as to whether the current level value is less than or equal to a threshold current value. If the value of step 316 equals "yes", the method advances to step 318. Otherwise, the method returns to step 316.

At step 318, the microcontroller 48 decreases the duty cycle of the pulse width modulated signal (V1) applied to the high side driver circuit 40 from the second duty cycle to a zero duty cycle to induce the high side driver circuit 40 to decrease the first control voltage (V4) applied to the electrical coil 170 from the second voltage level to the ground voltage level, respectively, over a fourth time interval (e.g., T3-T4) to transition the contactor 22 from the closed operational state to the open operational state. After step 318, the method advances to step 320.

At step 320, the microcontroller 48 stops generating the second voltage signal to the low side driver circuit 42 to induce the low side driver circuit 42 to stop conducting the electrical current from the electrical coil 170 of the contactor 22 therethrough to transition the contactor 22 from the closed operational state to the open operational state. After step 320, the method advances to step 322.

At step 322, the microcontroller 48 makes a determination as to whether the open command message corresponds to a second predetermined open command message (fast open command message). If the value of step 322 equals "yes", the method advances to step 324. Otherwise, the method is exited.

At step 324, the microcontroller 48 stops generating the pulse width modulated signal (V1) to induce the high side driver circuit 40 to decrease the first control voltage applied to the electrical coil 170 from the first voltage level to the ground voltage level, respectively, at a first time to immediately transition the contactor 22 from the closed operational state to the open operational state.

At step 326, the microcontroller 48 stops generating the second voltage signal that is applied to the low side driver circuit 42 to induce the low side driver circuit 42 to stop conducting the electrical current from the electrical coil 170 of the contactor 22 therethrough to immediately transition the contactor 22 from the closed operational state to the open operational state. The step 326 is performed simultaneously with the step 324.

The control system for a contactor provides a substantial advantage over other systems and methods. In particular, the control system transitions the contactor to a closed operational state, and then decreases a control voltage from a first voltage level to a second voltage level that is applied to a contactor coil. Thereafter, the control system maintains the control voltage at the second voltage level to maintain the contactor in the closed operational state. When the contactor is to be transitioned to an open operational state, the control system decreases the control voltage to a ground-level voltage such that a contactor armature contacts a stop member at a relatively low speed at the open operational state, and an amount of noise generated by the contactor when transitioning to the open operational state is significantly reduced.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A control system for a contactor, the contactor having an electrical coil and first and second electrical contacts, the control system comprising:

a current sensor generating a first signal indicating an amount of an electrical current flowing through the first and second electrical contacts, the first signal being received by a microcontroller;

a high side driver circuit electrically coupled to and between the microcontroller and a first end of the electrical coil of the contactor;

the microcontroller being programmed to generate a first voltage signal over a first time interval that is applied to the high side driver circuit to induce the high side driver circuit to apply a first control voltage at a first voltage level to the first end of the electrical coil of the contactor to transition the contactor from an open operational state in which the first and second electrical contacts are disposed apart from one another to a closed operational state in which the first and second electrical contacts are contacting one another;

the microcontroller being further programmed to generate a pulse width modulated signal that is applied to the high side driver circuit and to decrease a duty cycle of the pulse width modulated signal from a first duty cycle to a second duty cycle to induce the high side driver circuit to decrease the first control voltage applied to the electrical coil from the first voltage level to a second voltage level, respectively, over a second time interval;

the microcontroller being further programmed to maintain the second duty cycle of the pulse width modulated signal for a third time interval to induce the high side driver circuit to maintain the first control voltage applied to the electrical coil at the second voltage level for the second time interval to maintain the contactor in the closed operational state, the third time interval being greater than the second time interval;

the microcontroller being further programmed to receive an open command message requesting that the contactor be transitioned from the closed operational state to the open operational state;

the microcontroller being further programmed to determine a current level value indicating the amount of the electrical current flowing through the first and second electrical contacts, based on the first signal; and the microcontroller being further programmed to decrease the duty cycle of the pulse width modulated signal applied to the high side driver circuit from the second duty cycle to a zero duty cycle to induce the high side driver circuit to decrease the first control voltage applied to the electrical coil from the second voltage level to a ground voltage level, respectively, over a fourth time interval to transition the contactor from the closed operational state to the open operational state, if the current level value is less than or equal to a threshold current value, and the open command message corresponds to a first predetermined open command message.

2. The control system of claim 1, wherein the high side driver circuit comprises:

a low pass filter that receives the pulse width modulated signal and outputs a second control voltage in response to the pulse width modulated signal;

an operational amplifier electrically coupled to the low pass filter, the operational amplifier receiving the second control voltage and outputting a third control voltage having a magnitude greater than a magnitude of the second control voltage, in response to the second control voltage; and a voltage regulator electrically coupled to the operational amplifier, the voltage regulator receiving the third control voltage and outputting the first control voltage in response to the third control voltage, the first control voltage being applied to the electrical coil.

3. The control system of claim 1, wherein the threshold current value corresponds to zero amps.

4. The control system of claim 1, further comprising:

a low side driver circuit electrically coupled to and between the microcontroller and a second end of the electrical coil of the contactor;

the microcontroller being further programmed to generate a second voltage signal that is received by the low side driver circuit to induce the low side driver circuit to conduct an electrical current from the electrical coil therethrough, during the first, second, third, and fourth time intervals.

5. The control system of claim 4, wherein:

the microcontroller being further programmed to stop generating the second voltage signal after the fourth time interval to induce to the low side driver circuit to stop conducting the electrical current from the electrical coil therethrough.

6. The control system of claim 1, wherein the microcontroller being further programmed to stop generating the pulse width modulated signal to induce the high side driver circuit to decrease the first control voltage applied to the electrical coil from the first voltage level to the ground voltage level, respectively, at a first time to immediately transition the contactor from the closed operational state to the open operational state if the open command message corresponds to a second predetermined open command message.

7. The control system of claim 6, further comprising:

a low side driver circuit electrically coupled to and between the microcontroller and a second end of the electrical coil of the contactor;

the microcontroller being further programmed to stop generating a second voltage signal to induce to the low side driver circuit to stop conducting an electrical current from the electrical coil therethrough.

* * * * *